US008840039B2

(12) United States Patent
Crichton et al.

(10) Patent No.: US 8,840,039 B2
(45) Date of Patent: Sep. 23, 2014

(54) FLUID FEED SYSTEM IMPROVEMENTS

(75) Inventors: Daniel Crichton, Cambridgeshire (GB); Richard Wilhelm Janse Van Rensberg, Cambridgeshire (GB)

(73) Assignee: The Technology Partnership Plc, Herts (GB)

( * ) Notice: Subject to any disclaimer, the term of this patent is extended or adjusted under 35 U.S.C. 154(b) by 567 days.

(21) Appl. No.: 12/997,394

(22) PCT Filed: Jun. 10, 2009

(86) PCT No.: PCT/GB2009/050651

§ 371 (c)(1), (2), (4) Date: Feb. 11, 2011

(87) PCT Pub. No.: WO2009/150458

PCT Pub. Date: Dec. 17, 2009

(65) Prior Publication Data

US 2011/0121095 A1 May 26, 2011

(30) Foreign Application Priority Data

Jun. 11, 2008 (GB) ..... 0810668.4

(51) Int. Cl.

| | |
|---|---|
| ***B05B 17/06*** | (2006.01) |
| ***B05B 1/08*** | (2006.01) |
| ***B05B 1/14*** | (2006.01) |
| ***B05B 17/00*** | (2006.01) |

(52) U.S. Cl.

CPC ..... *B05B 17/0638* (2013.01); *B05B 17/0684* (2013.01)

USPC ..... 239/102.2; 239/326; 239/590.3

(58) Field of Classification Search

USPC ..... 239/102.1, 102.2, 44, 145, 302, 4, 6, 239/49, 86, 326, 590, 590.3; 222/187

See application file for complete search history.

(56) References Cited

U.S. PATENT DOCUMENTS

| | | | | |
|---|---|---|---|---|
| 4,530,450 | A | 7/1985 | Nandagiri | |
| 4,702,418 | A * | 10/1987 | Carter et al. | 239/101 |
| 4,966,313 | A | 10/1990 | Lina | |
| 5,261,601 | A * | 11/1993 | Ross et al. | 239/102.2 |
| 5,518,150 | A | 5/1996 | Witt, Jr. | |
| 5,518,179 | A * | 5/1996 | Humberstone et al. | 239/102.2 |
| 5,828,428 | A * | 10/1998 | Kim et al. | 349/40 |
| 6,085,740 | A * | 7/2000 | Ivri et al. | 128/200.16 |
| 6,202,943 | B1 | 3/2001 | Evans et al. | |
| 6,296,196 | B1 * | 10/2001 | Denen et al. | 239/4 |
| 2004/0265189 | A1 * | 12/2004 | Schwarz | 422/124 |
| 2006/0011733 | A1 * | 1/2006 | Varanasi et al. | 239/4 |
| 2009/0065600 | A1 * | 3/2009 | Tranchant et al. | 239/4 |

FOREIGN PATENT DOCUMENTS

| | | | |
|---|---|---|---|
| GB | 2 412 871 | A | 10/2005 |
| WO | WO-93/10910 | A1 | 6/1993 |
| WO | WO-97/29851 | A1 | 8/1997 |

(Continued)

*Primary Examiner* — Darren W Gorman

(74) *Attorney, Agent, or Firm* — Tarolli, Sundheim, Covell & Tummino LLP

(57) ABSTRACT

A fluid spray dispenser (2) having a fluid reservoir (20) for holding a fluid to be dispensed, a spray head (23) for dispensing the fluid and a porous medium (24) through which the fluid passes from the reservoir (20) to the spray head (23). The porous medium (24) has an effective pore size and/or permeability that decreases towards the spray head (23). Means and methods of creating the pore size and/or permeability gradients are discussed.

21 Claims, 5 Drawing Sheets

(56) References Cited

FOREIGN PATENT DOCUMENTS

| | | | |
|---|---|---|---|
| WO | WO-00/53337 | A1 | 9/2000 |
| WO | WO-2006/004902 | A1 | 1/2006 |
| WO | WO-2006/066671 | A1 | 6/2006 |

* cited by examiner

FLUID FEED SYSTEM IMPROVEMENTS

FIELD OF THE INVENTION

The invention relates to fluid feed systems for spray devices; in particular, to fluid feed systems utilising a porous medium to enable an electronic spray head to deliver consistent spray performance, regardless of the spray device orientation and the quantity of fluid remaining within the device's fluid reservoir.

BACKGROUND OF THE INVENTION

As a result of both the increasing demand from consumers for additional 'smart' functionality in spray products, and the ever-growing pressure to eliminate the greenhouse gas propellants inherent to traditional aerosol can technology, alternatives to traditional spray technologies are being sought. This has led to rapid growth in the field of electronic spray technologies such as that disclosed in PCT/GB92/02262. These devices bring environmental benefits as they do not require propellants and, because the spray is electronically generated, they provide repeatable, controllable performance.

For many applications such electronic spray products can be required to deliver high flow rates, operate in multiple or all orientations, and operate with the spray head above the bulk of the fluid in the primary operating orientation. Further, such fluid feeds should ensure that almost all of the fluid initially contained within the product's fluid reservoir can be sprayed, i.e. minimise residual fluid when the product stops functioning at an acceptable level. The move towards more compact products drives the fluid feed system to be space-efficient and, finally, a requirement on the user to prime the spray product manually should be avoided as this reduces the product's consumer appeal and the repeatability of the spray.

Thus there is a requirement for fluid feed designs which can deliver high flow rates in many or all orientations to such electronic spray heads that do not require a priming operation and that minimise un-sprayable residual fluid.

Many examples of fluid feed systems for spray devices are known in the art. For example, dip tubes are commonly used in manually pumped spray heads, for example U.S. Pat. No. 5,518,150 and U.S. Pat. No. 6,202,943. Dip tubes are also used in highly pressurised reservoirs for aerosol type applications as disclosed in U.S. Pat. No. 4,966,313. However such systems are not in general suitable for feeding electronic spray heads. Electronic spray heads generally will not pump air: if air gets into the dip tube then the device may fail.

To counter this problem porous media, generally in the form of wicks, have been used to deliver air-freshener formulations to electronic spray heads for example EP1159078 and PCT/GB92/02262. An advantage of these systems is that they can be self-priming, but a related drawback of these systems is that they can deliver only relatively low flow-rates and are generally restricted in the range of orientations in which they operate effectively.

A mechanically operated suction pump has been used to draw fluid against gravity to deliver it to an electronic spray head, as described in WO9729851. This approach enables the fluid to be drawn up to the electronic spray head in bulk, thereby enabling the desired high flow-rates to be achieved; however a drawback related to these systems is that they require a manual priming operation.

The prior art has attempted to overcome some of the drawbacks of these systems by the use of sponge-filled reservoirs for fluid delivery to an electronic spray head in WO06066671 and PCT/GB92/02262. Such systems can help to increase the range of orientations in which the spray can operate, but suffer from a degradation of spray delivery with time as the amount of fluid in the reservoir reduces, and these systems tend to result in a high level of residual fluid remaining in the sponge which cannot be dispensed.

SUMMARY OF THE INVENTION

The present invention is concerned typically with the field of fluid feed systems for electronic spray heads that consist of a reservoir containing fluid, together with a fluid transport element composed of a porous medium. When the reservoir is full, the porous medium is saturated with fluid and free fluid fills at least some of the space in the reservoir outside of the porous medium. As the reservoir empties, the free fluid may be replaced by air, or the reservoir volume may reduce, while the porous medium remains largely saturated with fluid. Finally, once all free fluid is exhausted, fluid is drawn out of the porous medium and air is ingested into the porous medium to replace it.

It is well known in the art to use a porous medium to transport fluid from a reservoir to an electronic spray head and a basic system suited to this is shown in FIG. 1. The present invention sets out to solve the problems of these known uses as described in detail in the following:

FIG. 1 shows a fluid dispenser 1 having an incollapsible reservoir 10 and an air inlet path 11 provided in the upper region of the reservoir. The free space 12 in the reservoir may be completely filled with free fluid, or partially filled as indicated by dashed lines 14 and 13. A porous medium 15 is provided to assist in feeding fluid to spray head 16 as the free fluid in the free space 12 is expelled by spray head 16 and replaced by air through air inlet path 11.

When the fluid reservoir 10 is not able to collapse as fluid is expelled from it, the fluid that is sprayed out must be replaced by the same volume of air, or some other immiscible fluid. A separate air inlet path 11 may be provided for this air to enter the reservoir but, for cost reduction or technical reasons, it may alternatively enter the reservoir through holes in the electronic spray head 16 itself. Further, when delivering fluid at high flow rates, nozzle-based spray heads may pump air back into the reservoir regardless of whether a separate air inlet path exists. This pumping of air into the reservoir can also occur even when the reservoir is collapsible and there is no differential pressure across the spray head. Any air that enters the reservoir through the spray head in this way has the potential to block the supply of fluid to the spray head. A fluid feed and reservoir system according to the present invention seeks to manage the flow of such incoming air to avoid blocking of the fluid feed to the spray head by air ingested through the spray head.

As the fluid in the reservoir is expelled and replaced by air, the pressure behind the spray head may change. The feed system needs to support this change. In particular, the feed system needs to continue to deliver fluid to the head when the fluid level in the reservoir is gravitationally below the level of the head. This is commonly achieved through the use of a homogeneous (but not necessarily isotropic) porous medium 15 that has pores small enough to support the required fluid rise height. By "homogeneous", we mean that the medium has uniform properties throughout its bulk when considered on a macroscopic scale (as distinguished from the microscopic pore-size scale). By "isotropic", we mean that the medium has the same physical structure and properties in all directions. For example, a fibre wick is usually homogeneous, but not isotropic and open cell reticulated foam is usually homogeneous and isotropic.

Different arrangements of the reservoir 10 and spray head 16 may give rise to different required rise heights required of porous medium 15. The relationship between maximum rise height and effective pore size is described by Equation 1 later in this specification. It shows that, for a fluid of given density and surface tension, as the required maximum rise height as measured from the bottom of reservoir 10 to the spray head 16 increases, the effective pore size in the entire medium must be reduced. However, as the effective pore size is reduced, the permeability of the medium generally also reduces, resistance to flow increases and this leads to a limit on the flow rate that can be achieved. Further, a spray head must work harder to draw fluid through a low-permeability medium. For portable electronic spray applications in particular, this can increase the cost of drive electronics and reduce battery and spray head life.

The present invention therefore seeks to provide a fluid feed and reservoir system capable of generating a sufficient fluid rise height, in combination with an improved permeability of the porous medium, which combination of properties allows higher flow rates to be achieved by the spray head being fed. The present invention further seeks to improve the performance of the fluid feed system by providing improved means of encouraging the displacement of air ingested into the porous medium such that fluidic pathways are less at risk from being broken down by air ingested into the porous medium.

In any dispensing system using porous media fluid feeds, air may be ingested into the porous medium either from the free space in the reservoir, via the spray head, or via both of these routes.

Air may be ingested into the porous medium via the spray head regardless of the fluid level in the reservoir, and can cause the fluidic pathways in the medium to break down. This can cause a reduction in the flow rate achieved, as increasing numbers of pathways within the medium break down as more air is ingested. It is therefore advantageous to encourage any air ingested via the spray head to move away from the vicinity of the spray head, leaving fluidic pathways to the spray head intact, yet none of the prior art makes specific provision for the removal of air from the porous medium.

Providing a pore size gradient in the porous medium can encourage ingested air to move away from the spray head. Providing ingested air with the shortest possible route to the edge of the medium and on to any free space in the reservoir can also reduce the amount of air residing in the porous medium. The provision of pathways through the medium from adjacent to the spray head to the edge of the medium can help to encourage air away from the spray head and on to the edge of the medium and any free space in the reservoir. These methods assist in the removal of air from the medium and thus reduce the risk of breaking down fluidic pathways.

To aid the understanding of the present invention and the terms used in the claims, it will be beneficial to understand the following theory and definitions of terms:

Effective pore size can also be described as the equivalent capillary tube radius required to provide the same rise-height in a simple capillary tube as is achieved in the porous medium for a given fluid.

The required tube radius for a simple capillary tube achieving a given rise-height can be calculated from the following equation, which gives the maximum achievable rise-height as:

$$h_{max} = \frac{2\sigma\cos\alpha}{\rho g R} \qquad \text{(Equation 1)}$$

where $\rho$ is the fluid density, $\sigma$ is the fluid surface tension, g is the acceleration due to gravity, R is the capillary tube radius, $h_{max}$ is the maximum rise height and $\alpha$ is the contact angle made between the fluid and the capillary wall.

To calculate an effective pore size, the same equation can be applied to porous media, with contact angle $\alpha$ tending to zero at $h_{max}$, to find an effective radius of the pores in a sample. However, due to the complex microscopic structure of porous media, these media generally consist of a range of actual pore sizes within a given volume of medium. Therefore the value of R must be considered as an effective pore size as calculated for a finite section of a medium, based upon the rise height achieved by a sample having the properties of that section.

Further, porous media generally exhibit hysteresis and so the values of R and $h_{max}$ may be different for the same media depending on whether it starts being saturated and surrounded by fluid which is then drained, or it starts being dry and is brought into contact with the same fluid.

In the present description and claims, when we refer to effective pore size, we mean that derived from the rise height measured from a fully-saturated starting condition and calculated according to Equation 1 above.

Experiments to determine the effective pore size in a sample can be conducted as follows:

When using equation 1 to determine effective pore size, it is necessary to pump fluid out of a full reservoir through the medium in order to find the maximum rise-height achieved and thus calculate an effective pore size, R.

For a homogeneous media this approach is actually measuring the effective pore size at the top of the sample, furthest away from the reservoir fluid level, as this is the point at which the fluidic pathways will break down first.

For a non homogeneous medium or a compressed homogeneous medium, the fluidic path may not fail at the top of the sample. This is because, in an ideal embodiment of this invention, the effective pore size gradient through the sample brings about a situation in which the medium is transporting fluid close to its maximum achievable rise-height at numerous points along the fluidic path. Therefore, in this case the value of R obtained from equation 1 can be called an effective pore size for the whole sample of the medium, in the orientation in which it is being operated.

One way of detecting a gradient in effective pore size within a sample of medium is to perform the same rise-height experiment with the sample under different orientations; a homogeneous medium will exhibit the same maximum rise height, a non-homogeneous medium will exhibit differing rise heights with the maximum rise height achieved when the smaller effective pore size is at the maximum height.

Using fluids of reduced surface tension and/or increased density for the above experiments will reduce the rise height achieved. This can help ensure that the maximum rise height is less than the overall sample length so that breakdown of the fluidic pathways can be observed.

It is also important to note that two media may exhibit equal rise heights when a sample of each dry medium is brought into contact with a fluid, but that these same two media may support different rise heights when starting from a fully-saturated condition. At least two effective pore sizes may therefore be defined for a given medium. In the following description and claims, when we refer to effective pore size, we mean that derived from the rise height measured from a fully-saturated starting condition and calculated according to Equation 1 above.

Considering the flow of fluid along a saturated, inclined porous medium of length L, the flow rate per unit area, q is a function of several variables;

$$q = \frac{K(\varphi_{in} - \varphi_{out})}{L} \text{ where } K = \frac{k\rho g}{\mu} \text{ and } \varphi = z + \frac{p_i}{\rho g}$$

K is commonly referred to as the hydraulic conductivity and is proportional to the permeability, k, and fluid density, ρ, and inversely proportional to the fluid viscosity, μ. ϕ is a measure of the potential and is a function of the vertical height, z and the fluidic pressure, $p_i$. From this it can be seen that for a positive flow rate the change in potential must be negative. For cases where the fluid exit height is gravitationally above the fluid entry height this requires that the fluidic pressure at the exit location be lower than the fluidic pressure at the entry location. This fluidic pressure reduction at the fluid exit location is, in this case, created by the spray head pumping the fluid out of the reservoir. From this it can be understood that the lower the permeability k of the medium, the higher the required pressure differential, and the harder the spray head must work, provided that the other variables are kept constant.

Permeability is a well known term in the art and there are many known ways of measuring the permeability of a sample of porous medium.

Differences in the permeability of a sample of porous medium from one point to another may be detected by measuring pressure-drops across those points for a given flow-rate of fluid through the medium. It will be appreciated that pressure drops should be measured over the same distance at each point to get an accurate comparison of the permeability at each point.

The permeability of a porous medium is, in general, approximately proportional to the square of its pore radius. Therefore, reducing the effective pore size so as to increase the rise height results in a large reduction in permeability. Since the spray head can generally only provide a limited pressure differential, this reduction in permeability k results in a reduction in the achievable flow rate q.

It is therefore advantageous to reduce the effective pore size, and resulting permeability, only as much as is necessary to achieve the rise-height required at each point along the fluidic pathway in the medium.

The effective pore size in a porous medium can be influenced by a number of factors. These include: the uniformity of the pore size in a medium, how pores of a different size are distributed in the medium, how pores interconnect in the medium and the mean pore size in the medium.

To calculate these or other statistical properties of the medium the concept of a 'representative elementary volume' is useful. This volume is large enough so as to contain enough pores such that the statistical properties within it represent the average properties of the medium at the location in question, but is not so big that non-homogeneity of the overall medium is seen.

To determine the representative elementary volume and calculate the statistical properties at a location in the medium, first calculate the properties of the medium over a specified volume or area where this volume or area is of the order of the pore size. Then increase this volume or area by small amounts and recalculate the statistical properties until any significant fluctuations in the calculated properties from one increment to the next are removed.

According to the present invention there is provided a fluid spray dispenser comprising:

a fluid reservoir for, in use, holding fluid to be dispensed;

a spray head for dispensing the fluid; and a porous medium through which, in use, fluid passes from the reservoir to the spray head, the porous medium having an effective pore size that decreases towards the spray head.

The decreasing effective pore size of the medium facilitates an improved permeability of the medium for a given rise height and therefore an improved flow rate for a given rise height and spray head power.

The porous medium may also have a permeability when saturated that decreases towards the spray head. Reducing the permeability towards the spray head allows the overall permeability to be maximised and related pressure drop to be minimised in regions away from the spray head.

The present invention further provides a fluid spray dispenser comprising:

a fluid reservoir for, in use, holding fluid to be dispensed;

a spray head for dispensing the fluid; and a porous medium through which, in use, fluid passes from the reservoir to the spray head, the porous medium having a permeability, when saturated, that decreases towards the spray head.

The spray head may have a non-planar form. Adapting the medium for use with a spray head of non-planar form allows differing plume shapes to be generated whilst maintaining the advantages of the present invention.

The effective pore size and/or permeability may decrease at a constant rate towards the spray head. A constant rate of decrease in effective pore size may give an advantageous permeability increase for a given achievable rise height.

The effective pore size and/or permeability may decrease smoothly towards the spray head. A smooth, but not necessarily constant, decrease in effective pore size will give an advantageous permeability increase for a given achievable rise height. A rate of decrease that keeps effective pore size multiplied by the maximum rise height required at the location in question constant will give the maximum increase in overall permeability for the idealised case.

The effective pore size and/or permeability may decrease in one or more step changes. Step changes in effective pore size and/or permeability can allow the medium to be constructed from a plurality of sections of media, each having a different effective pore size.

The effective pore size and/or permeability may decrease over only part of the medium extending between the reservoir and the spray head. Pore size and/or permeability changes extending through only a part of the medium allow the remaining parts to be constructed of homogenous porous media.

The effective pore size and/or permeability of the medium may be constant in the region immediately adjacent to the spray head. The variations in pore size and/or permeability may be more easily created in regions a small distance from the spray head.

At least the region of the medium immediately adjacent to the spray head may have a negative effective pore size gradient and/or permeability gradient in the direction of the spray head. In certain arrangements the pore size and/or permeability gradient may give the greatest benefit in the region adjacent to the spray head.

The porous medium may have a varying effective pore size and/or permeability as an inherent property. Manufacturing the medium with variations in effective pore size and/or permeability inherent to it may reduce the complexity of the construction of the fluid feed and reservoir system.

The porous medium may be supported by a structure which, by compression of at least part of the medium, causes the desired effective pore size and/or permeability gradient to be formed in the medium. Where the medium cannot be manufactured with an inherent effective pore size and/or permeability gradient, the creation of stresses in the medium by an enclosing or supporting structure can facilitate the creation of the required pore size and/or permeability gradients.

The following constructions can be used to create the desired pore size and/or permeability gradients within the porous medium:

The supporting structure may have a shape which, when assembled with the porous medium, creates stresses in the porous medium to create an effective pore size gradient and/or permeability gradient by expanding and/or compressing pores in certain regions.

The structure may hold the porous medium under any of compressive, tensile and torsional stress to create a two dimensional or three dimensional effective pore size gradient and/or permeability gradient within the medium.

The structure may be formed from either the same material or a different material to the porous medium. Forming the structure of a different material to the porous medium can allow greater or lesser stresses to be created in the porous medium and may facilitate the manufacture of more complex supporting structures with more suitable physical properties.

At least one pathway may be formed in the porous medium adjacent the spray head for the removal of ingested air. The pathway acts to remove the air to reduce the risk of air ingested by the spray head blocking the supply path of fluid to the spray head.

The pathway may be a channel(s) formed substantially at the centre of the spray head. Forming the channel at the centre of the spray head is advantageous because the maximum distance that air ingested anywhere on the spray head has to travel through the non-modified porous medium before reaching the edge of the porous medium is minimised.

The channel may be lined by a different material to the porous medium in order to maintain the shape of the channel.

The channel may be conic in shape, with the narrow end adjacent the head. This arrangement is advantageous because a slug of air trapped within the tube will try to minimise its surface area. A small movement of the slug towards the larger radius end will reduce the overall surface area and therefore air will tend to move from the smaller radius end towards the larger radius end.

The pathway may be formed from one or more connected pores whose size is greater than that of the pores in the surrounding region. Creating the channel from larger pores within the medium itself removes the need for separate components or channels to remove the air.

The pathway may be a void formed in the porous medium. Forming a void in the porous medium to remove the ingested air also removes the need for separate components and enables ingested air to enter the channel at multiple locations along its length.

The spray head may include a piezoelectric actuator and a perforate membrane.

BRIEF DESCRIPTION OF THE DRAWINGS

One example of the present invention will now be described with reference to the following drawings in which.

DESCRIPTION OF PREFERRED EMBODIMENTS

Figure 1:
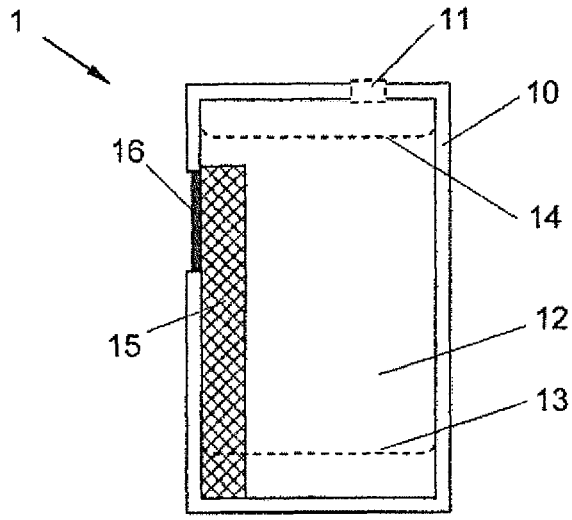
Figure 1 (Prior Art)
FIG. 1 is a dispenser arrangement using a homogenous porous medium as can be derived from the prior art.
Figure 2:
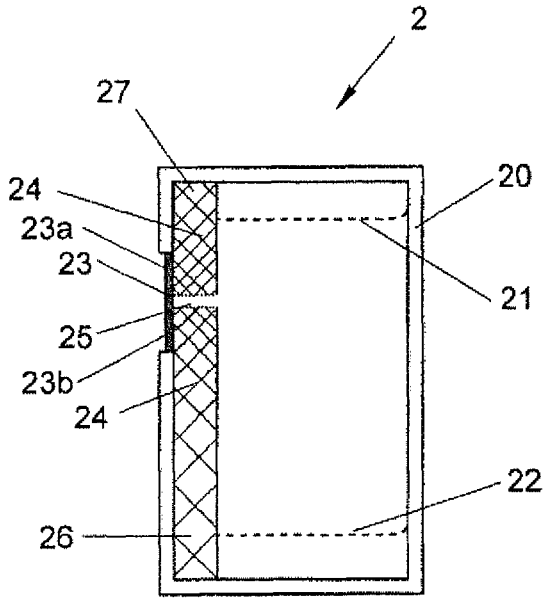
FIG. 2 is a dispenser according to the present invention, making use of both pore size gradients and an air removal path.

FIG. 2 shows a dispenser 2 having a fluid reservoir 20 which may be completely filled with fluid, or partially filled with fluid to either of levels 21 and 22 for example. Spray head 23 is fed with fluid from the reservoir. Spray head 23 may have a piezoelectric actuator 23*a* and a perforate membrane 23*b*. A porous fluid feed 24 is provided to allow a continued supply of fluid to spray head 23 as the level of free fluid in the reservoir drops from level 21 to level 22 when fluid is expelled from the reservoir by spray head 23. Porous medium 24 has an effective pore size that decreases in a manner such that the effective pore size adjacent to spray head 23 and air inlet channel 25 is smaller than that at its opposite extremities 26 and 27. This is denoted by the changing density of the cross-hatching in FIG. 2. It will be appreciated that when the reservoir is completely full of fluid, porous medium 24 will be fully saturated with the fluid. Pathway 25 is provided to allow air ingested by spray head 23 to be channelled away from the spray head and towards the free fluid contained in the reservoir 20.

Figure 3:
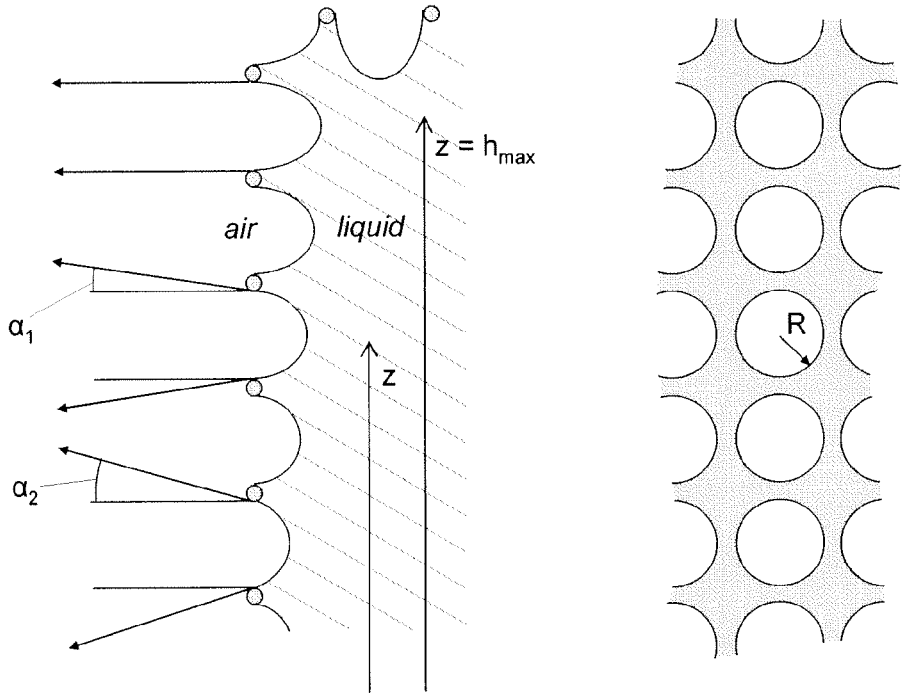
FIG. 3 is an idealised representation of a porous medium.
Figure 4:
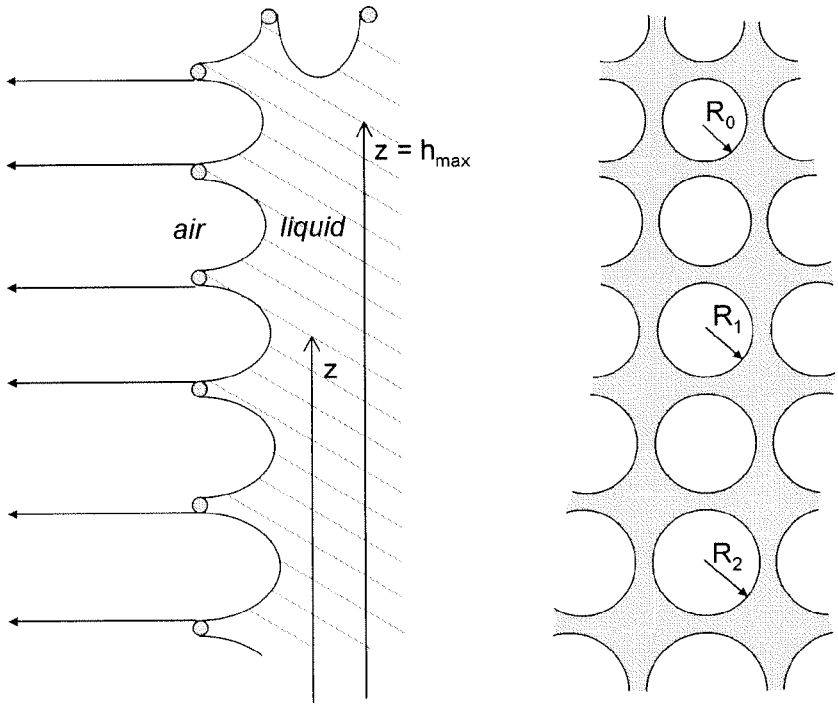
FIG. 4 is an idealised representation of a porous medium showing improvements over the media in FIG. 3 as per this invention.

FIGS. 3 and 4 help to demonstrate the advantages of reducing the effective pore size towards the spray head.

Firstly, while the effective pore size needs to be small enough to support the required fluid rise height, it should also be as large as possible to give maximum flow rate. The permeability, which affects flow rate, is linked to the pore sizes along the entire fluidic path from the free liquid in the reservoir to the spray head. The maximum rise height is only required at the location of the spray head, with reduced rise height required away from the spray head. Therefore increasing the effective pore size at each point away from the spray head, whilst still supporting the required rise height at that point, will increase permeability and lead to a lower overall fluid feed resistance and improved spray performance. This is illustrated by FIG. 3 and FIG. 4, both of which show idealised representations of open cell reticulated foam. In FIG. 3 an idealised representation of a homogenous porous media is shown at the liquid-air interface just below the maximum fluid rise height. At the maximum rise height, the contact angle, $\alpha$, tends to zero and the surface tension, $\sigma$, multiplied by the length over which it acts, $\pi R$, balances the pressure force in the liquid, $\rho g h_{max}$, multiplied by the area over which this acts, $\pi R^2$. Below this maximum height the pressure force reduces and therefore the contact angle increases ($0<\alpha_1<\alpha_2$) so as to maintain the balance of forces. For the present invention, an idealised example of which is illustrated in FIG. 4, the pore size, R increases as you move away from the maximum rise height location ($R_2>R_1>R_0$). For the optimised case, the rate of change in R is such that it balances the reduction in pressure (R multiplied by z is constant) and, at the liquid-air interface, the contact angle remains zero or close to zero. An alternative relationship which can give advantageous properties is where permeability k (which is proportional to $R^2$) multiplied by $z^2$ is kept constant. Where the term 'smooth' is used in relation to the decrease in effective pore size or permeability in this description or corresponding claims, we refer to a decrease approximately according to either of these relationships. The preferred relationship is the former, where R multiplied by z is constant. By use of a material whose properties are an approximation to either or both of these relationships, or whose properties lie somewhere in between them, the advantages of the present invention may be realised.

Figure 5A:
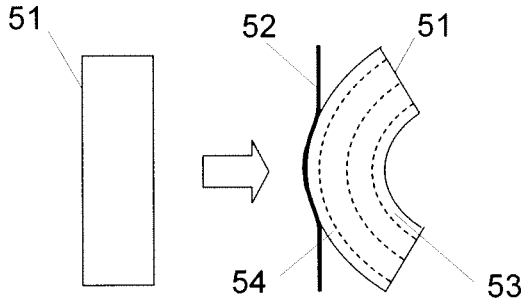
FIG. 5 shows two means of deforming media to contact a domed spray head which introduce a pore size gradient opposite to what is required for optimal spray head performance.
Figure 5B:
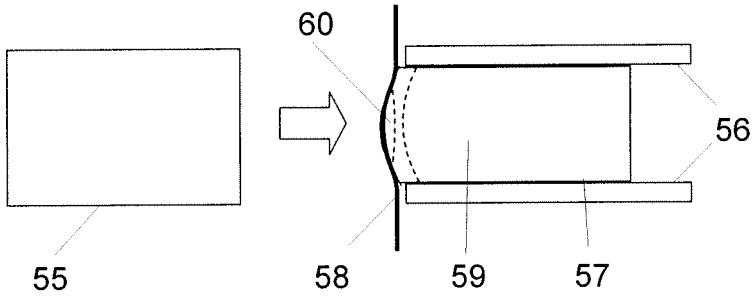

Non-planar spray heads with either of one or two dimensional curvature are often used to give particular plume characteristics. However, compressing a planar section of porous media against such a head will lead to the effective pore size increasing towards the head. This would encourage the trapping of any ingested air next to the head and thus block the fluidic pathways through the medium. FIG. 5A and FIG. 5B illustrate ways in which this non-desirable pore size gradient may occur. For example, in FIG. 5A, a section of porous medium 51 bent into shape behind a non-planar spray head 52 will have compressed regions 53 further from the spray head and expanded regions 54 adjacent the spray head. This will create a pore size gradient which is opposite to that required by the present invention.

An alternative method of ensuring contact between the porous medium and the spray head is to take a piece of medium of the form shown by the square 55 in FIG. 5B, and compress it between two elements 56. The medium will then adopt a compressed form 57, such that the end contacting spray head 58 deforms to match the curvature of the spray head. This too creates regions of compression 59 and regions of expansion 60. Again, the pore size gradient created is opposite to that required by the present invention.

Figure 6:
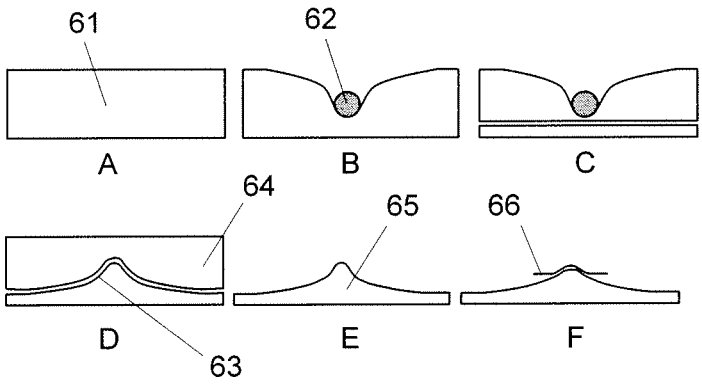
FIG. 6 shows one way of cutting homogeneous porous media such that when brought into contact with a domed spray head, the pore size gradient in the vicinity of the head is either zero or beneficial in nature.

FIG. 6 describes a method by which the non-desirable pore size gradients described in FIG. 5 may be avoided, and a preferred pore size gradient obtained in the vicinity of a non-planar spray head.

A porous medium of non-planar profile may be manufactured according to the process shown in FIG. 6. In step A, a planar sample 61 of porous medium is selected. In step B, the sample is than deformed using a shaped part 62. Step C illustrates how a planar cut is then performed below the level of the shaped part 62. In step D the shaped part 62 is removed and the porous medium returns to its relaxed state with the desired profile 63. Off-cut 64 may then be discarded to leave a formed section of porous medium 65 as illustrated in step E. The remaining porous medium 65 may then be brought into contact with the spray head 66. The process may be adapted to create a section of porous medium with an outer profile of a chosen radius, or a different shape or size. If a section of homogenous porous medium is created such that, in its relaxed state, the radius of curvature of its outer profile is the same as that of the spray head, then no pore size gradient will be created. If the radius of curvature of the porous medium is smaller than that of the spray head then compression of the medium against the spray head results in the preferential pore size gradient required by the present invention.

Figure 7:
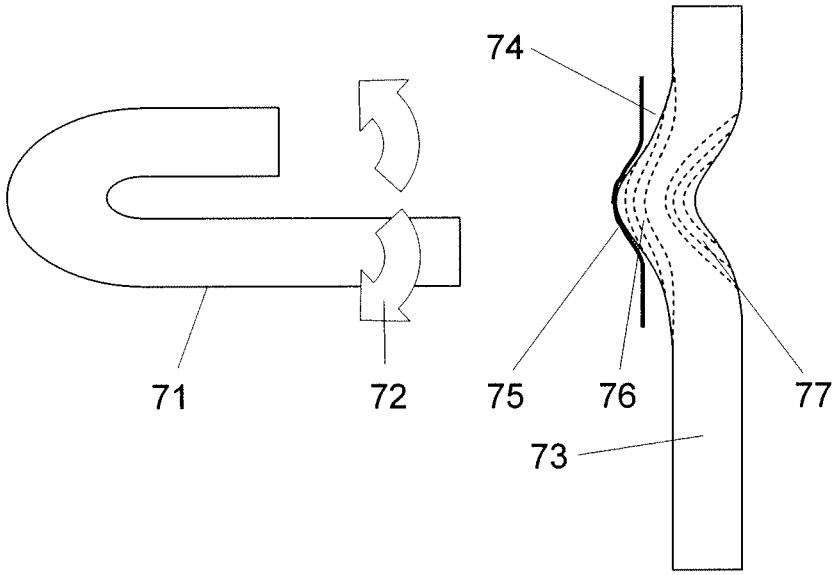
FIG. 7 shows one way of deforming homogeneous porous media such that when brought into contact with a domed spray head, the pore size gradient in the vicinity of the head is beneficial in nature.

FIG. 7 illustrates an alternative method of creating the desired pore size gradient within a porous medium behind a domed spray head. Firstly, a section of porous medium 71 which, in its relaxed state, has a U-shaped, or revolved U-shaped, form is prepared. This section of medium 71 is then deformed in the directions of arrows 72 into a new shape 73. This is performed such that the curvature of the outer side of the medium 74 matches the curvature of the spray head 75. This process creates a compressed region 76 next to the spray head and an expanded region 77 away from the spray head. In this way, a pore size gradient as preferred by the present invention is created.

Both continuous gradients in pore size and discrete changes in pore size are beneficial and can be achieved in several ways in addition to those shown in FIGS. 6 and 7. The porous media may be manufactured to be inherently non-homogenous, i.e. the desired pore size gradient may be created in the porous medium during its manufacture, such that, in its relaxed state, the porous medium displays the desired pore size gradient.

An alternative method of creating changes in effective pore size is by placing multiple homogenous porous media in contact with each other, each section having a different effective pore size.

A section of porous medium which, in its relaxed state is homogenous, may be compressed, stretched and/or twisted so as to induce preferable gradients in pore size. Such deformations may be achieved by a supporting structure, which may itself be made of a porous medium or of a non-porous medium. This supporting structure may be, for example, the fluid reservoir housing, or the spray head itself.

Figure 8A:
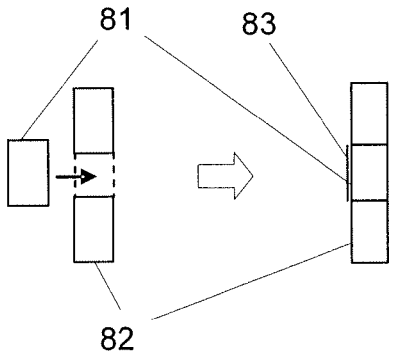
FIG. 8 shows examples of methods that can be employed to create beneficial pore size gradients using homogeneous porous media.
Figure 8B:
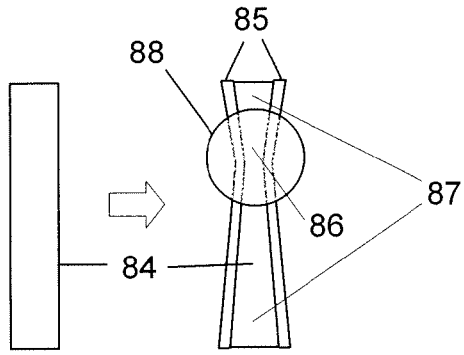

Examples of such deformation methods are shown in FIGS. 8A and 8B. A core of porous medium 81 in FIG. 8A may be compressed into a hollow tube 82 of a similar medium, causing the inner core to be compressed and the outer tube to expand. The spray head 83 can then be located next to the core, where the smallest pore size occurs.

An alternative method of creating the desired pore size gradient is illustrated in FIG. 8B. Here, a block of porous medium 84 may be compressed between two fixed walls 85. The walls will create areas of greater compression 86 and areas of lesser compression 87. The spray head 88 may then be located at the point of maximum compression 86 created by fixed walls 85.

As the dispenser is used and liquid is ejected from the reservoir by the spray head, any free liquid in the reservoir will eventually be used up, and air will start to replace the liquid in the porous media. The smaller the effective pore size, the more energy is required to displace the liquid, therefore keeping pore sizes as large as possible is beneficial. Further, providing a gradient in effective pore size by any of the means described above through the provision of a continuous gradient, or a series of discrete changes, will lead to liquid furthest away from the spray head being preferentially displaced first. With the smallest effective pore sizes located adjacent to the spray head, displacement of the liquid furthest away from the spray head in the larger pores will act to maintain the fluidic pathways from the spray head to the remaining fluid for longer than if the effective pore size were homogenous. This results in more of the stored liquid being sprayable.

Any air that is ingested through the spray head can block fluidic pathways in the porous medium and cause a reduction in flow rate. It is therefore important that such air should be encouraged to move away from the spray head. Providing a pore size gradient in the vicinity of the spray head can encourage air to move away from the spray head.

Figure 9:
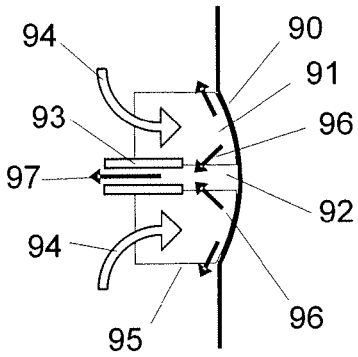
FIG. 9 shows one means of employing paths specifically to enable the movement of air away from the spray head.

Most porous media has a distribution of pore sizes, meaning that air can also become trapped in larger pores if surrounding smaller pores are filled with liquid. In general therefore, it is desirable that any ingested air has only a short path to the edge of the porous medium, or to larger pores leading directly to the edge of the medium. This reduces the likelihood of ingested air becoming trapped and blocking the path of fluid to the spray head. To provide any ingested air with the desirable shortest possible route to the edge of the porous medium it is possible to provide one or more pathways in the medium specifically for the removal of air. FIG. 9 shows a cross section of one possible spray head and fluid feed system to demonstrate an example of how this may be achieved. During spraying, air may be ingested through the spray head 90. Once ingested, air will either enter the porous medium 91 or a pathway 92 designed for the removal of air. In one embodiment, this air pathway may be supported by another material 93. To avoid blocking the fluidic pathways 94 through the porous medium, any air ingested into the medium needs to exit the medium. It may do this by travelling either directly to the edge of the medium 95, or through a pathway 96, 97, provided for this purpose. Minimising the distance ingested air must travel through the medium before reaching its edge is crucial to maintaining the performance of the spray device.

Figure 10:
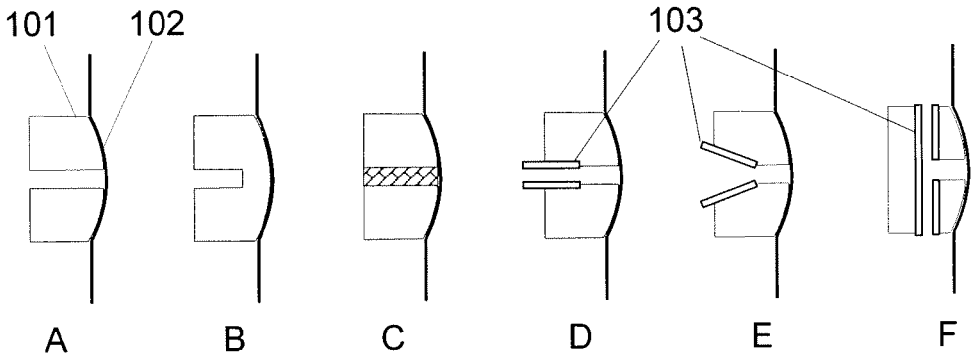
FIG. 10 shows examples of air path constructions that can be employed to ensure air is not trapped behind the spray head, impacting spray performance.

Alternative methods of creating air channels for the removal of air from the vicinity of the spray head are shown in FIG. 10. Each alternative within FIG. 10 shows a cross section of the porous medium 101 in the vicinity of a domed spray head 102 with optional structural components 103 to support the medium in the vicinity of the air channels where appropriate.

In example A, the pathways may be created as one or more voids in the porous medium, each connecting the spray head to an edge of the porous medium. A drawback of this embodiment is that the air removal pathways may collapse if no structural supporting element is provided.

In example B, the pathways are provided as one or more voids in the porous medium, each pathway connecting a point close behind the spray head to an edge of the porous medium.

Example C illustrates how the pathway may consist of a region of pores having an effective size larger than the pores in the surrounding medium. Such a pathway could be formed during manufacture, or through the use of an insert of alternative porous medium. This insert may also help to provide structural support to the pathway to ensure that it is kept open. This avoids the potential drawback of embodiment A.

Example D shows an alternative means of keeping the pathway open by supporting it with a structural component(s).

Example E shows the use of structural components which may be conical in shape. This can further encourage the movement of air away from the spray head when the free liquid in the reservoir is at a level which fully immerses the spray head and adjacent porous medium in liquid.

Example F shows a way in which multiple separate paths may be employed to assist in the removal of air from the vicinity of the spray head.

The invention claimed is:

1. A fluid spray dispenser comprising:

a fluid reservoir for, in use, holding fluid to be dispensed;

a spray head for dispensing the fluid, the spray head having a non-planar form; and a porous medium extending from the reservoir to the spray head through which, in use, fluid passes along a fluid path from the reservoir to the spray head, the porous medium having an effective pore size that decreases along at least a part of the fluid path from the reservoir towards the spray head, the part of the fluid path along which the effective pore size decreases being within the reservoir;

wherein the effective pore size of the medium is constant in the region immediately adjacent to the spray head.

2. A fluid spray dispenser according to claim 1, wherein the porous medium has a permeability, when saturated, that decreases towards the spray head.

3. A dispenser according to claim 1, wherein the effective pore size decreases smoothly from the reservoir to the spray head.

4. A dispenser according to claim 1, wherein the porous medium has a varying effective pore size as an inherent property.

5. A fluid spray dispenser comprising:

a fluid reservoir for, in use, holding fluid to be dispensed;

a spray head for dispensing the fluid; and a porous medium extending from the reservoir to the spray head through which, in use, fluid passes along a fluid path from the reservoir to the spray head, the porous medium having an effective pore size that decreases along at least a part of the fluid path from the reservoir towards the spray head, the part of the fluid path along which the effective pore size decreases being within the reservoir;

wherein the porous medium is supported by a structure which, by deforming at least part of the medium, causes the desired effective pore size gradient to be formed in the medium.

6. A fluid feed according to claim 5, wherein the medium, in its relaxed state, has a substantially 'U-shaped' form.

7. A fluid feed according to claim 5, wherein a section of porous medium is compressed by opposing walls whose profile creates areas of greater compression and areas of lesser compression within the medium.

8. A dispenser according to 5, wherein the structure is made from a porous medium arranged around an inner section of porous medium and maintaining the inner section in a compressed state within the structure.

9. A dispenser according to claim 1, further comprising a pathway formed in the porous medium adjacent the spray head for the removal of ingested air.

10. A dispenser according to claim 9, wherein the pathway is a channel lined by a different material to the porous medium in order to maintain the shape of the channel.

11. A dispenser according to claim 1, wherein the spray head includes a piezoelectric actuator and a perforate membrane.

12. A fluid spray dispenser comprising:

a fluid reservoir for, in use, holding fluid to be dispensed;

a spray head for dispensing the fluid, the spray head having a non-planar form; and a porous medium extending from the reservoir to the spray head through which, in use, fluid passes along a fluid path from the reservoir to the spray head, the porous medium having a permeability, when saturated, that decreases along at least a part of the fluid path from the reservoir towards the spray head, the part of the fluid path along which the permeability when saturated decreases being within the reservoir; and wherein the permeability of the medium is constant in the region immediately adjacent to the spray head.

13. A dispenser according to claim 12, wherein the permeability decreases smoothly from the reservoir to the spray head.

14. A dispenser according to claim 12, wherein the porous medium has a varying permeability as an inherent property.

15. A fluid spray dispenser comprising:

a fluid reservoir for, in use, holding fluid to be dispensed;

a spray head for dispensing the fluid; and a porous medium extending from the reservoir to the spray head through which, in use, fluid passes along a fluid path from the reservoir to the spray head, the porous medium having a permeability, when saturated, that decreases along at least a part of the fluid path from the reservoir towards the spray head, the part of the fluid path along which the permeability when saturated decreases being within the reservoir;

wherein the porous medium is supported by a structure which, by deforming at least part of the medium, causes the desired permeability gradient to be formed in the medium.

16. A fluid feed according to claim 15, wherein the medium, in its relaxed state, has a substantially 'U-shaped' form.

17. A fluid feed according to claim 15, wherein a section of porous medium is compressed by opposing walls whose profile creates areas of greater compression and areas of lesser compression within the medium.

18. A dispenser according to any of claim 15, wherein the structure is made from a porous medium arranged around an inner section of porous medium and maintaining the inner section in a compressed state within the structure.

19. A dispenser according to claim 12, further comprising a pathway formed in the porous medium adjacent the spray head for the removal of ingested air.

20. A dispenser according to claim 19, wherein the pathway is a channel lined by a different material to the porous medium in order to maintain the shape of the channel.

21. A dispenser according to claim 12, wherein the spray head includes a piezoelectric actuator and a perforate membrane.

* * * * *